US005994264A

United States Patent [19]

Sherman et al.

[11] Patent Number: 5,994,264

[45] **Date of Patent: *Nov. 30, 1999**

[54] TRANSFER PRINTING OF METAL USING PROTECTIVE OVERCOAT

[75] Inventors: Louis R. Sherman, Botkins; Michael E. Purdy, Troy, both of Ohio

[73] Assignee: American Trim, LLC, Lima, Ohio

[ * ] Notice: This patent is subject to a terminal disclaimer.

[21] Appl. No.: 08/990,652

[22] Filed: Dec. 15, 1997

Related U.S. Application Data

[63] Continuation-in-part of application No. 08/925,107, Sep. 8, 1997, which is a continuation of application No. 08/698,266, Aug. 14, 1996, abandoned, which is a continuation of application No. 08/476,523, Jun. 7, 1995, abandoned.

[51] Int. Cl.[6] ..... B41M 5/035; B41M 5/38

[52] U.S. Cl. ..... 503/227; 156/235; 428/913; 428/914

[58] Field of Search ..... 8/471; 428/195, 428/913, 914; 503/227; 156/235

[56] References Cited

U.S. PATENT DOCUMENTS

| | | | |
|---|---|---|---|
| 3,705,166 | 12/1972 | Murayama et al. | 260/293.86 |
| 4,145,512 | 3/1979 | Uhrhan et al. | 528/73 |
| 4,153,596 | 5/1979 | Oertel et al. | 260/45.8 N |
| 4,205,151 | 5/1980 | Dale et al. | 526/262 |
| 4,210,612 | 7/1980 | Karrer | 525/204 |
| 4,587,155 | 5/1986 | Durand | 428/466 |
| 4,668,239 | 5/1987 | Durand | 8/471 |
| 4,670,084 | 6/1987 | Durand | 156/540 |
| 4,804,717 | 2/1989 | Ramey et al. | 525/375 |
| 4,895,901 | 1/1990 | Ramey et al. | 525/127 |
| 5,267,755 | 12/1993 | Yamauchi et al. | 283/86 |
| 5,290,424 | 3/1994 | Mozelewski et al. | 205/160 |
| 5,318,942 | 6/1994 | Laudy et al. | 503/227 |
| 5,427,997 | 6/1995 | Oshima et al. | 503/227 |
| 5,494,885 | 2/1996 | Kudo et al. | 503/227 |
| 5,658,850 | 8/1997 | Taniguchi et al. | 503/227 |
| 5,856,267 | 1/1999 | Sherman et al. | 503/227 |

FOREIGN PATENT DOCUMENTS

| | | | |
|---|---|---|---|
| 1108929 | 9/1981 | Canada | 428/209 |
| 9221514 | 12/1992 | WIPO | 503/227 |

*Primary Examiner*—Bruce H. Hess
*Attorney, Agent, or Firm*—Rankin, Hill, Porter & Clark LLP

[57] ABSTRACT

A process for coating and transfer printing sheet metal for producing a decorated section of metal that is especially suited for use in harsh environments. The process yields a section of metal having a transfer printed layer comprising a thermoset coating material and a protective overcoat layer formed of substantially clear thermoset coating material. The process includes the steps of coating a section of metal with a pigmented thermosetting coating material, curing the coating material to form a base coat layer, transfer printing the base coat layer to form a transfer printed layer, applying a protective clear thermosetting coating material over the transfer printed layer, and curing the protective clear thermosetting coating material so as to provide a clear protective overcoat layer covering the transfer printed layer.

15 Claims, 1 Drawing Sheet

TRANSFER PRINTING OF METAL USING PROTECTIVE OVERCOAT

RELATED APPLICATIONS

This application is a continuation-in-part of application Ser. No. 08/925,107 filed Sep. 8, 1997 entitled TRANSFER PRINTING METAL SUBSTRATES which is a continuation of application Ser. No. 08/698,266 filed Aug. 14, 1996 which is now abandoned, which is a continuation of application Ser. No. 08/476,523 which was filed Jun. 7, 1995 and which is now abandoned.

BACKGROUND OF THE INVENTION

1. Field of the Invention

This invention relates to transfer printing of sheet metal and in particular to a method of applying a pigmented base coat and optionally a clear topcoat over the pigmented base coat, transfer printing an image on the pigmented base coat or the topcoat, and then applying a protective overcoat over the transfer printed layer or coating.

2. Background Art

Transfer printing of inks or dyes into a variety of articles such as shirts, mugs, plastic articles and plastic coated substrates is well known in the art. Dispersible dye crystals or inks are printed in reverse images in transfer paper which is to be used to transfer print the article to be decorated. The article to be decorated is usually made of plastic or has a plastic or polymer coating on it into which the dyes are transferred. However, some transfer printing can be effective with most synthetic materials including the fibers in shirts.

Most transfer printing is referred to as sublimation printing in which the dyes are said to sublimate under heat and pressure to be driven into any receptive substrate that is put in contact with the transfer paper. Such sublimation printing was developed circa 1969 and has been used extensively to print many articles including plastic coated metal substrates.

Transfer printing also includes a melt printing process which is as described in several patents and patent applications including U.S. Pat. Nos. 4,587,155; 4,670,084; 4,668,239 and Published Application WO 92/21514. According to U.S. Pat. No. 4,587,155, the desired dye image is transferred from the paper to the substrate by heating the dye to a temperature above its melting point but below its vaporization temperature so that the dye will diffuse into the softened plastic substrate. Published Application WO 92/21514 describes melt printing of planar metal base members such as aluminum, steel or the like which have been coated on at least one planar surface with a melt printable layer of softenable, dye-permeable, thermoplastic or thermoset material such as polyethylene terephthalate, polybutylene terephthalate or other thermoplastic polyesters, polycarbonates, nylons and the like. Application WO 92/21514 further describes bilayer coatings of thermoplastic or thermoset materials including a base coat optimally provided with a pigment and a second layer that can comprise a clear resin. The application states that neither the composition nor the thickness of either the substrate or the printable plastic layers is critical.

Canadian Patent 1,108,929 describes a process for applying designs to unsealed, anodized aluminum which is continuously heated to a temperature at which colored components of ink will sublime. The heated strip is fed into contact with an ink carrying web so the ink is heated and transferred into the anodized aluminum surface. The decorated aluminum strip is then cooled with water and passed through a sealing bath filled with a sealing solution such as buffered aqueous nickel.

An improved process is needed for coating metal substrates for transfer printing to produce decorated sheets having consistent bright coloring with little or no texturing of the surface of the sheet. The process should produce decorated sheet metal that can be subsequently formed into shaped articles such as formed control panels or three dimensional pictures and signs without cracking or crazing of the coatings on the sheet metal. Coatings which have typically been used on transfer printed metal substrates cannot withstand the stringent forming requirements which include required bends with radii equal to approximately twice the metal thickness or more. Prior art coatings have also had poor resistance to ultraviolet light (UV) exposure and have frequently stained when exposed to washing aids such as bleach and solvent-based spot removers or to food products and alkalis. A process is needed for producing a thin, clear coating which has a uniform thickness with virtually no pin holes or other defects which might interfere with transfer printing including sublimation printing and melt printing. Improved transfer printed metal sheets are needed which are suitable for manufacture into a variety of products such as control panels, one-piece three-dimensional pictures and frames, and signs.

SUMMARY OF THE INVENTION

This invention provides a process for coating metal sheets which are especially well suited to be transfer printed with decorative or informative images. The invention further provides a process for manufacturing transfer printed metal sheets and provides decorated sheets produced by such process which display improved environmental durability. In accordance with this method, cleaned strip metal or metal sheets are coated with a pigmented base coat. Optionally, a clear topcoat may be applied over the base coat. The coated metal is then transfer printed as by sublimation printing or alternatively by melt printing to form a transfer printed layer. The preferred method for applying the base coat and the optional topcoat is by roll coating or reverse roll coating. Both the base coat and the topcoat are preferably thermoset resins which are heat cured on the sheet. The base coat includes a pigment such as titanium dioxide. When a topcoat is employed, preferably the topcoat is clear so the inks or dyes which are transferred into the topcoat will produce a bright precise image on the sheet. In some applications, preferably both the base coat and the topcoat are thin such as approximately 0.0004 to 0.001 inch thick. When a topcoat is utilized, preferably the topcoat should be uniform in thickness and have virtually no pin holes or other defects which would interfere with producing a clear and consistent image in the coating. After the transfer printing step, a clear overcoat is applied. Preferably, the overcoat comprises a thermosetting coating material that protects the transfer printed layer from environmental conditions.

Accordingly, an object of this invention is to provide an improved process for coating sheet metal which is adapted to be decorated by transfer printing and which afford an end product of improved durability.

A further object is to provide transfer printed metal sheets having improved clarity, uniformity of print quality, resistance to UV light and resistance to staining or chemical attack, and which are adapted to be formed into three-dimensional shapes by bending the decorated metal on radii as small as two metal thicknesses.

The above and other objects and advantages of this invention will be more fully understood and appreciated with reference to the following description and the claims appended hereto.

DESCRIPTION OF PREFERRED EMBODIMENTS

Figure 1:
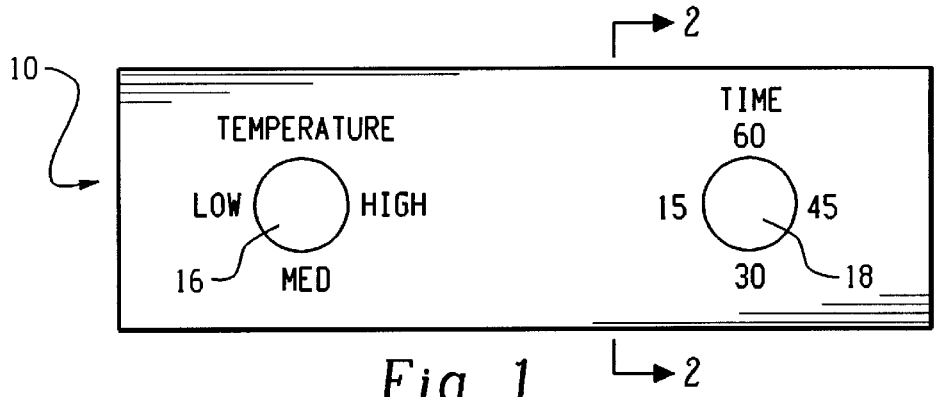
FIG. 1 is a plan view of a control panel which has been produced in accordance with this invention.
Figure 2:
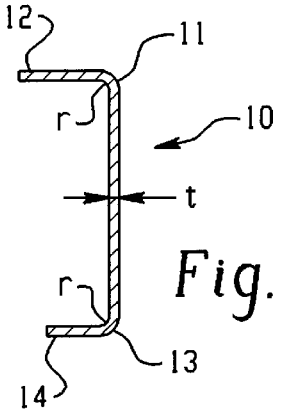
FIG. 2 is a cross-sectional view through the panel of FIG. 1 taken along line 2—2 in FIG. 1.

Referring to the drawings, FIGS. 1 and 2 show a control panel 10 which is suitable to be produced in accordance with this invention. The panel is made from sheet metal and preferably sheet aluminum which is about 0.010 to 0.040 inch thick and preferably about 0.019 inch thick. In a preferred embodiment, the aluminum can be a 3000 or 5000 series alloy such as 3003 or 5052, as designated by the Aluminum Association, in an intermediate to hard temper. As best seen in FIG. 2, the panel 10 has been formed to provide flanges on it for attachment. The radii "r" at corners 11, 13 may be as small as two times metal thickness "t" which puts considerable stress and strain in any coatings on the panel. Holes 16, 18 have also been punched or cut in the panel 10 for receiving pins, not shown, for dials or knobs to be attached for operating machine controls. The panel has also been coated and printed with instructions and setting for operation of the equipment to which the panel relates (e.g., cooking devices, washing devices, drying devices, industrial machines and equipment, etc.).

Figure 3:
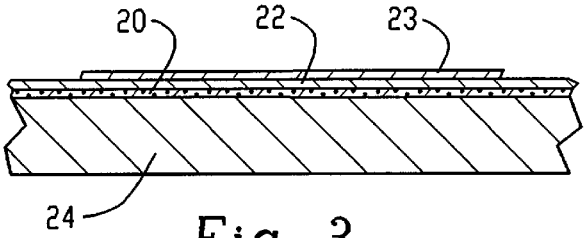
FIG. 3 is an enlarged fragmentarily cross-sectional view of the panel of FIG. 1.

FIG. 3 is an enlarged cross section through the panel 10 of FIGS. 1 and 2 showing a base coat 20 and a topcoat 22 on the metal substrate 24. The base coat 20 may be a variety of thermosetting polymers such as polyesters, epoxies or the like, and has a pigment such as titanium dioxide in it to provide a solid color background for printing. In a preferred embodiment, the base coat 20 is a thermosetting polyester enamel such as white enamel sold by Lilly Industries, Inc. of Indianapolis, Ind. under Code 95101-7299. Such enamel has a viscosity of 22+2 seconds on a #4 Zahn scale at 80° F., a flash point of about 90–100° F., a weight of about 12 pounds per gallon and contains approximately 66% solids.

The topcoat 22 may also be a variety of thermosetting polymers such as polyesters and epoxies. A preferred topcoat 22 is a thermosetting polyester sold by Lilly Industries, Inc. under Code 95110-7300. This resin has a viscosity of about 20+2 seconds on a #4 Zahn scale, weighs about 8.5 pounds per gallon and contains about 53% solids. The topcoat must be substantially clear so it will not screen or interfere with visibility of the transfer ink or dyes which are diffused into the coating.

It is important to this invention that the coatings 20 and 22 be thermoset resins which will not soften when the coated material is heated as when the panel 10 is transfer printed or later heated during use of the panel on a washing device or the like. Thermoset polymers are also not soluble in solvents or the like that can cause discoloration or degradation of the coatings. Provided on topcoat 22 is an overcoat 23 that serves as a protective coating. Overcoat 23 is preferably a clear thermosetting polymer such as polyesters, epoxies or the like. Preferably, overcoat 23 for certain applications includes a UV stabilization additive. Such additive may be a material selected from the group consisting of hindered amines, benzoates, benzotriazoles, benzophenones, salicylates and mixtures thereof. Such additive materials are commercially available. In applications such as decorated signage which is exposed to extensive UV light or actinic radiation, the use of an overcoat containing UV stabilizers is greatly preferred. In applications where UV light is not a consideration, but chemical durability is required, for example, inside the lid of a washing machines, use of an overcoat serves to preserve the quality and life of the transfer printed image.

The use of topcoat 22 is optional for certain applications. For example, where the clarity of printing is not critical transfer printing may be conducted directly upon base coat 20 and then the overcoat 23 applied.

In many applications, preferably both the base coat 20 and the topcoat 22 have a thickness of from about 0.0004" to about 0.001". Overcoat 23 is applied to a thickness of from about 0.0004" to about 0.003" and preferably from about 0.0004" to about 0.001".

An example of a coating material that may be utilized to provide an overcoat where UV light is not an issue is Deco Rad 7812 (clear) coating material available from Deco Chem Inc. of Mishawaka, Ind. Deco Rad 7812 is a UV curable cross-linking/thermosetting material. Deco Rad 7812 may be applied to a thickness of about 0.0005" and then cured using a 400 watt/inch UV light source for 2.5 seconds. (Additional details as to overcoat—for example viscosity).

An example of an overcoat that may be used where UV light is an issue may be prepared by mixing the following:

| Component | Parts By Weiqht |
|---|---|
| SS27 available from Naz-Dar/KC of Chicago, IIIinois | 90 |
| [1]TINUVIN 1130 UV light absorber | 5 |
| [1]TINUVIN 292 hindered amine | 3 |
| [2]BKY 451 catalyst | 2 |

[1]Available from Ciba-Geigy of Torrytown, New York.
[2]Available from Bky-Chemie, USA of Wallingford, Connecticut.

(Further details as to mixture - viscosity, etc.)

This overcoat system is applied to a thickness of about 0.0005" and then cured by heat, for example, at 350° F. for about 4 minutes.

Figure 4:
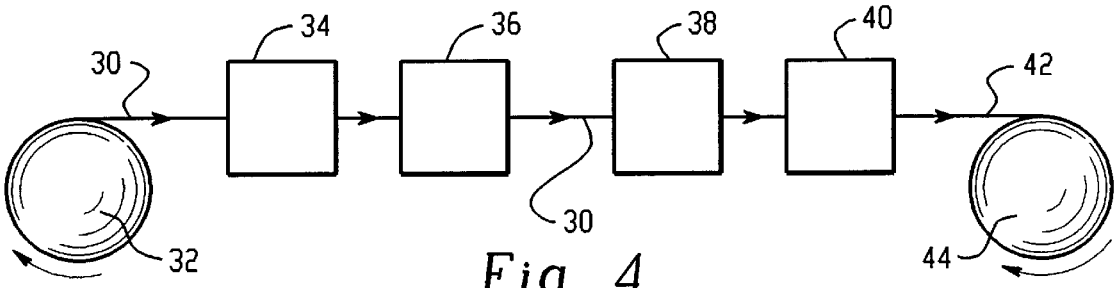
FIG. 4 is a flow sheet of a process for continuously coating metal substrate in accordance with this invention.

FIG. 4 is a flow sheet of a preferred process of this invention for applying the base coat, topcoat (optional) and overcoat onto a metal substrate. The metal substrate is in strip form and has preferably been cleaned as for example with a Betz MetChem solution such as Betz 1010 to remove oils, grease or other contaminants from at least one surface of the strip. As shown in FIG. 4, the metal strip 30 is uncoiled from coil 32 and moves continuously between a first roll coater 34 which applies the base coat, then through an oven 36 for curing the base coat on the strip. If a topcoat is to be employed, the strip 30 next travels between a second roll coater 38 for applying the topcoat. From the second roll coater, the strip 30 moves through a second oven 40 for curing the topcoat. The base coat and topcoat are preferably cured at about 350–450° F., and more preferably about 410° F. for about 20–40 seconds, and more preferably about 30 seconds. The coated strip 42 is rewound on coil 44. The strip 42 is subsequently cut into individual sheets in preparation for transfer printing of the sheets. Alternatively, the strip can be cut into individual sheets without being rewound into a coil.

Figure 5:
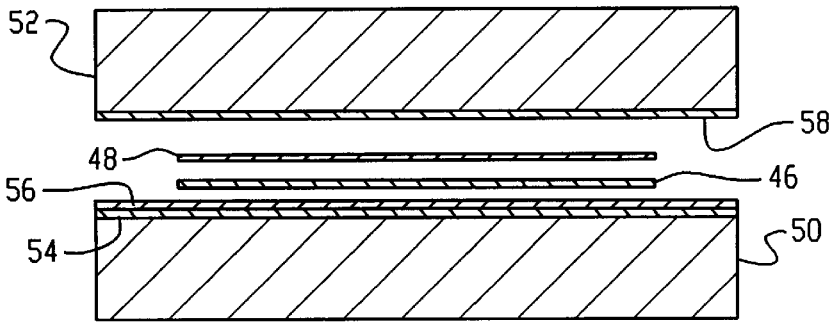
FIG. 5 is a cross-section through apparatus for sublimation printing of metal substrate which has been coated in accordance with this invention.

FIG. 5 shows a printing press apparatus for sublimation printing of a sheet 46 of coated substrate in accordance with this invention where the topcoat is utilized. The apparatus includes a base or bottom platen 50 on which a coated metal sheet 46 and a sheet of transfer paper 48 are positioned and a top platen 52 for pressing the sheet of transfer paper 48 against the metal sheet to transfer dyes from the paper into the topcoat on the metal sheet. The bottom platen preferably has a layer of rubber such as silicone 54 and a felt mat 56 on it for distributing the pressing force against the metal sheet. The top platen preferably has a layer or sheet 58 of polymeric material such as a fluorocarbon thermoplastic such as Teflon (a trademark of E. I. duPont de Nemours and Company, Inc. for tetrafluoroethylene) on its bottom surface to protect the surface of the platen and provide a slightly resilient surface to apply pressure uniformly against the paper 48 and metal sheet as supported by the bottom platen. The top platen 54 also preferably has heating means such as electrical heating rods or coils, not shown, for heating the transfer paper 48 and metal sheet 46. Alternatively, the bottom platen 50 or both the bottom and top platens can have heating coils in them for heating the metal sheet and transfer paper. In a preferred embodiment, the bottom platen 50 is moved vertically (as for example with air bags, not shown) to press the paper 48 and metal sheet 46 tightly together to heat them and cause sublimation transfer of the dye or dyes into the topcoat on the metal sheet. As used herein "dye" is used to mean either dye or ink which may be used to create an image and/or color in a substrate. In one preferred embodiment, the top platen 52, paper 48 and metal sheet 46 are heated to about 375–450° F. and pressed together under a pressure of approximately 50–80 psi. The peak metal temperature in sheet 46 is preferably about 350–370° F. The heat and pressure is held for a cycle time in a range of about 10–60 seconds depending on a variety of factors such as the dye colors, kinds and quantity of dyes to be transferred, coating composition, and pressures employed. The transfer press is then opened by lowering the bottom platen, and the decorated sheet 46 and expended paper are removed from the press.

In a preferred mode of operation, the transfer paper has spots of adhesive applied to its top surface so the paper will at least temporarily stick to the top platen 52 when the press is opened after completion of printing. The adhesive may, for example, be diluted Elmers (a trademark of Borden, Inc.) glue. With such adhesive, the paper is temporarily adhered to the top platen 52, and within a few seconds after opening of the press the expended paper will fall from the platen to be discarded. Meanwhile, the decorated sheet 48 can be removed from the press so the sheet 48 will not be degraded by the expended transfer paper.

Once the transfer printed image has been produced, the overcoat layer may be applied over the layer which has been transfer printed. Curing will, of course, depend upon the specific material utilized for the overcoat (e.g., heat or UV curing).

The process of this invention is well adapted for producing decorated sheet metal that can be formed into three-dimensional articles such as control panels, one-piece pictures and frames which are durable and attractive, and signage which is continually exposed to harsh environmental conditions. The coatings of this invention are thin, uniform in thickness, durable and especially well suited for transfer printing of clear, well defined images. The coated and decorated substrates can be formed with small radii of curvature without cracking or crazing of the coatings. Most prior art transfer printed articles have been shaped before they were coated and/or printed because the coatings and/or decorations could not survive the forming process without damage.

Having provided a detailed description of preferred embodiments for practicing the invention, it will be apparent to those skilled in the art that numerous modifications can be made in such embodiments without departing from the invention or the scope of the claims appended hereto. For example, the coated strip metal can also be decorated in strip form before it is cut into individual sheets. Additionally, it will be appreciated that it may be possible to form base coat 20 and topcoat 22 using a single application of coating material that is specially formulated to provide during curing a pigmented base layer and a clear top layer. Another alternative includes preheating the coated metal sheets before they are placed in the apparatus of FIG. 5 for sublimation printing. A further alternative for the apparatus of FIG. 5 includes moving the top platen, instead of the bottom platen to open and close the press for transfer printing. A still further alternative includes printing coated strip metal continuously or semi-continuously before the strip is cut into individual sheets. Other alternatives falling with the scope of the invention will be apparent to those skilled in the art.

What is claimed is:

1. A process for decorating a sheet of metal comprising:

(i) providing a sheet of metal having at least one substantially clean surface;

(ii) coating said clean surface with a thermosetting coating material containing a pigment;

(iii) curing the thermosetting coating material on said surface so as to provide a first coat layer;

(iv) transfer printing said coated metal so as to provide a transfer printed layer;

(v) coating said transfer printed layer with a protective clear thermosetting coating material; and (vi) curing said protective clear thermosetting coating material so as to provide a substantially clear protective overcoat layer covering at least a portion of said transfer printed layer.

2. A process as set forth in claim 1 wherein said clear thermosetting coating material includes an effective amount of a light stabilization additive that serves to protect the transfer printed layer from the degradative effects of actinic radiation.

3. A process as set forth in claim 2 wherein said clear thermosetting coating material utilized to form said overcoat layer comprises a UV light curable coating material.

4. A process as set forth in claim 3 wherein said curing step (vi) is performed using a source of UV light.

5. A process as set forth in claim 2 wherein said stabilization additive comprises a material selected from the group consisting of hindered amines, benzoates, benzotriazoles, benzophenones, salicylates and mixtures thereof.

6. A process as set forth in claim 1 including the step of coating the first coat layer with a substantially clear thermosetting coating material and curing the clear thermosetting coated material so as to provide a substantially clear second coat layer disposed over at least a portion of said first coat layer, said transfer printing being conducted on said second coat layer and said second coat layer thereby forming said transfer printed layer.

7. A process as set forth in claim 1 wherein said first coat layer upon curing forms a pigmented thermoset base coat and a substantially dear thermoset topcoat disposed over said base coat, said transfer printing being conducted on said topcoat layer and said topcoat layer thereby forming said transfer printed layer.

8. A decorated metal substrate comprising a section of metal having disposed thereon a layer formed of a pigmented thermoset coating material, said layer having disposed thereon a transfer printed layer comprising a layer of thermoset coating material having a transfer printed image disposed therein, and a protective overcoat layer disposed over said transfer printed layer.

9. A decorated metal substrate as set forth in claim 8 wherein said transfer printed layer comprises a substantially clear thermosetting coating material having said transfer printed image disposed therein.

10. A decorated metal substrate as set forth in claim 9 wherein said pigmented thermoset coating layer includes a thickness of from about 0.0004" to about 0.001".

11. A decorated metal substrate as set forth in claim 9 wherein said substantially clear thermosetting coating layer includes a thickness of from about 0.004" to about 0.001".

12. A decorated metal substrate as set forth in claim 8 wherein said overcoat layer includes an effective amount of a light stabilization additive that serves to protect the transfer printed layer from the degradative effects of actinic radiation.

13. A decorated metal substrate as set forth in claim 12 wherein said light stabilization additive comprises a material selected from the group consisting of hindered amines, benzoates, benzotriazoles, benzophenones, salicylates and mixtures thereof.

14. A decorated metal substrate as set forth in claim 8 wherein said overcoat layer comprises a UV light initiated cured material.

15. A decorated metal substrate as set forth in claim 8 wherein said overcoat layer includes a thickness of from about 0.0004" to about 0.003".

* * * * *